US009533858B2

(12) United States Patent
Hanninen et al.

(10) Patent No.: US 9,533,858 B2
(45) Date of Patent: Jan. 3, 2017

(54) ELEVATOR INSTALLATION AND A METHOD FOR CONTROLLING ELEVATORS

(71) Applicants: Ari Hanninen, Hyvinkaa (FI); Tapio Tyni, Hyvinkaa (FI)

(72) Inventors: Ari Hanninen, Hyvinkaa (FI); Tapio Tyni, Hyvinkaa (FI)

(73) Assignee: KONE CORPORATION, Helsinki (FI)

( * ) Notice: Subject to any disclaimer, the term of this patent is extended or adjusted under 35 U.S.C. 154(b) by 0 days.

(21) Appl. No.: 15/011,143

(22) Filed: Jan. 29, 2016

(65) Prior Publication Data

US 2016/0145075 A1 May 26, 2016

Related U.S. Application Data

(63) Continuation of application No. PCT/FI2013/050856, filed on Sep. 5, 2013.

(51) Int. Cl.
*B66B 1/30* (2006.01)
*B66B 1/34* (2006.01)

(52) U.S. Cl.
CPC *B66B 1/302* (2013.01); *B66B 1/34* (2013.01)

(58) Field of Classification Search
CPC ..... B66B 1/302; B66B 1/34
See application file for complete search history.

(56) References Cited

U.S. PATENT DOCUMENTS 5,894,910 A 4/1999 Suur-Askola et al.
8,083,033 B2 * 12/2011 Kallioniemi ..... B66B 1/2458 187/290

(Continued)

FOREIGN PATENT DOCUMENTS

JP 2013-184773 A 9/2013
WO WO-9617798 A1 6/1996

(Continued)

OTHER PUBLICATIONS

International Search Report PCT/ISA/210 for International Application No. PCT/FI2013/050856 Dated Feb. 20, 2014.

(Continued)

*Primary Examiner* — Robert W Horn
(74) *Attorney, Agent, or Firm* — Harness, Dickey & Pierce, PLC

(57) ABSTRACT

The invention relates to an elevator installation and also to a method for controlling elevators. In the method a run plan is formed for driving elevator cars on the basis of service requests, the elevator cars are driven according to the run plan, by supplying electric power via the electricity distribution network of the building to a hoisting machine driving an elevator car, and also by supplying electric power from a hoisting machine braking an elevator car back to the electricity distribution network of the building, alternatives for a run plan are formed for driving elevator cars on the basis of service requests, the electric power which the hoisting machines need for implementing the aforementioned alternatives is determined, and also a run plan is selected for use from the plurality of different alternatives, when implementing which run plan the electric powers of the hoisting machines, when summed together, smooth the power variation occurring in the electricity supply of the building.

32 Claims, 8 Drawing Sheets

(56) References Cited

U.S. PATENT DOCUMENTS

| | | | | |
|---|---|---|---|---|
| 8,714,313 | B2 * | 5/2014 | Harkonen | B66B 1/302 187/289 |
| 2008/0105499 | A1 * | 5/2008 | Tyni | B66B 1/2458 187/382 |
| 2008/0185234 | A1 * | 8/2008 | Harkonen | B66B 1/302 187/290 |
| 2013/0075199 | A1 | 3/2013 | Kauppinen et al. | |
| 2015/0144434 | A1 * | 5/2015 | Herkel | B66B 1/302 187/276 |
| 2016/0145075 | A1 * | 5/2016 | Hanninen | B66B 1/302 187/289 |

FOREIGN PATENT DOCUMENTS

| | | | |
|---|---|---|---|
| WO | WO-0165231 | A2 | 9/2001 |
| WO | WO-2011148043 | A1 | 12/2011 |

OTHER PUBLICATIONS

Written Opinion of the International Searching Authority PCT/ISA/237 for International Application No. PCT/FI2013/050856 Dated Feb. 20, 2014.

* cited by examiner

ELEVATOR INSTALLATION AND A METHOD FOR CONTROLLING ELEVATORS

This application is a continuation of PCT International Application No. PCT/FI2013/050856 which has an International filing date of Sep. 5, 2013, the entire contents of which are incorporated herein by reference.

FIELD OF THE INVENTION

The invention relates to the optimization of the power usage of elevators.

BACKGROUND OF THE INVENTION

The electrical energy requirement of elevators varies at different times. During a run the power requirement is essentially greater than during a standstill of the elevator. The load of the elevator car as well as, inter alia, the magnitude of the counterweight of the elevator car affect the power consumption during a run.

The fuses of a rising main in a building as well as the cables are usually dimensioned according to a greater required power. Generally the costs of a mains electricity connection of a building increase when the dimensioning of the fuses/the power requirement of the building increases.

From the viewpoint of the electricity provider, a wide-ranging power variation can be a problem, because it might cause, among other things, oscillation in the frequency of the electricity network.

AIM OF THE INVENTION

The aim of the invention is consequently to smooth the load caused in the electricity supply of a building by the operation of elevators without this causing any detriment to the users of the elevators.

To achieve this aim the invention discloses an elevator installation as defined in claim 1, an elevator system as defined in claim 17 and a method as defined in claim 19.

One aim of the invention is to smooth the load caused in the main supply of a building by the operation of elevators without this causing any detriment to the users of the elevators. To achieve this aim the invention discloses an elevator installation as defined in claim 13 and also a method as defined in claim 29.

One aim of the invention is to smooth the load caused in the public electricity network by the operation of elevators without this causing any detriment to the users of the elevators. To achieve this aim the invention discloses an elevator installation as defined in claim 14 and also a method as defined in claim 30.

One aim of the invention is to smooth the load caused in the reserve power device of a building by the operation of elevators without this causing any detriment to the users of the elevators. To achieve this aim the invention discloses an elevator installation as defined in claim 15 and also a method as defined in claim 31.

The preferred embodiments of the invention are described in the dependent claims. Some inventive embodiments and inventive combinations of the various embodiments are also presented in the descriptive section and in the drawings of the present application.

SUMMARY OF THE INVENTION

Elevator installation in a building in which there is an electricity distribution network that is connected to the electricity supply of the building. The elevator installation comprises a plurality of elevator cars as well as a control, which is configured to form a run plan for driving the elevator cars on the basis of service requests. The elevator installation further comprises a plurality of hoisting machines as well as a plurality of power supply devices for a hoisting machine that are connected to the electricity distribution network of the building, each of which power supply devices is configured to drive an elevator car according to a run plan with a hoisting machine, by supplying electric power via the electricity distribution network to a hoisting machine driving an elevator car as well as by supplying electric power back to the electricity distribution network from a hoisting machine braking an elevator car. The aforementioned control is configured to form alternatives for a run plan for driving elevator cars on the basis of service requests, to determine the electric power which the hoisting machines need for implementing the aforementioned alternatives, and also to select for use from the plurality of different alternatives a run plan, which when implemented causes the electric powers of the hoisting machines, when summed together, to smooth the power variation occurring in the electricity supply of the building. When smoothing the momentary power variation the load, i.e. the maximum current, exerted on the electricity supply of the building by operation of the elevators decreases. At the same time, however, power is received evenly via the electricity distribution network of the building, so that the elevators or other electrical devices do not need to be removed from use owing to overload. Consequently the operation of the elevator installation and of the other electrical devices of the building can continue without causing extra detriment to users. The advantages to be achieved with the solution further increase in large buildings as the number of elevators driving simultaneously increases, in which case the momentary power variation in the electricity supply of the building decreases even more.

The electricity supply of a building is generally dimensioned according to the maximum power requirement. Although the energy consumption of elevators is, in fact, only approx. 5 percent of the total energy consumption of a building, the momentary peak power requirement of elevators usually corresponds to approx. 50 percent of the power consumption of the whole building. Consequently by means of the solution according to the description—by reducing the power variation caused by elevators—the dimensioning of the electricity supply of a building can be significantly reduced. This is also economically important to the owners of a building, because the investment costs for the electricity supply of a building increase by approx. 300 euros per each kilowatt needed (contract charge approx. 100 euros/KW, transformers approx. 100 euros/KW, reserve power systems approx. 100 euros/KW).

In some embodiments the aforementioned electricity supply of a building is the main supply of the building. This means that electric power can be received via the main supply more evenly than is known in the art. In some embodiments also the fuse size of the main supply can at the same time be reduced.

In some embodiments the aforementioned electricity supply of a building is a reserve power device. This means that electric power can be received from a reserve power device more evenly than is known in the art. At the same time the load exerted on the reserve power device usually also decreases at the same time. Consequently the dimensioning of the reserve power device needed can be reduced or the transport capacity of the elevator installation being supplied with the reserve power device can be increased.

In some embodiments the control is connected with a data transfer bus to the building automation apparatus, with which the electricity consumption of devices external to the elevator installation is controlled, and that the building automation apparatus is configured to change the electricity consumption of the devices external to the elevator installation in a manner specified by the control on the basis of a change command to be received from the control. The control is further configured to form a change command for changing the electricity consumption of the devices external to the elevator installation and also to select for use from the plurality of different alternatives a run plan, which when implemented causes the electric powers of the hoisting machines, when summed together with the changed electricity consumption of the devices external to the elevator installation, to smooth the power variation occurring in the electricity supply of the building. This means that the control can affect the power variation occurring in the electricity supply of the building very efficiently by optimizing at the same time both the power consumption of the hoisting machines and also the power consumption of the devices external to the elevator installation. The aforementioned devices external to the elevator installation in a building can be e.g. the heating apparatus for household water, air-conditioning apparatus, a heating system and lighting.

In some embodiments the control is connected to a data transfer bus that is external to the building for adjusting the power limit of the main supply, and the control is configured to change the power limit of the main supply on the basis of a control signal to be received from the data transfer bus external to the building. This means that the power limit of the main supply can be changed on the basis of a control signal received from the electricity provider via the data transfer bus external to the building. In this case the operation of the elevator installation can still continue with sufficient transport capacity in a situation in which the electric power available for operating the elevators from the public electricity network has decreased.

The control preferably comprises a processor and also a memory, in which is recorded an optimization program to be executed with the microprocessor. In the optimization program the control is configured to function in the manner disclosed in the description. An optimization program means a computer program in which a calculation relating to the operating parameters of the elevator installation, such as to elevator waiting times, energy consumption, power consumption and/or transport capacity, can be performed. In some preferred embodiments the optimization program also comprises one or more optimization algorithms, by using which a run plan that best corresponds to the set objectives can be selected from a plurality of alternatives, said objectives being such as a set limit value for the power of the electricity supply of the building, an objective for minimizing the power variation of the electricity distribution network of the building, an objective for reducing the power variation of the public electricity network, et cetera. In some embodiments a genetic algorithm is used as an optimization algorithm.

According to one aspect, in the method for controlling elevators a run plan is formed for driving elevator cars on the basis of service requests and also the elevator cars are driven according to the run plan, by supplying electric power via the electricity distribution network of the building to each hoisting machine driving an elevator car, as well as by supplying electric power back to the electricity distribution network of the building from a hoisting machine braking an elevator car. Further, in the method alternatives for a run plan are formed for driving elevator cars on the basis of service requests, the electric power which the hoisting machines need for implementing the aforementioned alternatives is determined, and also a run plan is selected for use from the plurality of different alternatives, when implementing which run plan the electric powers of the hoisting machines, when summed together, smooth the power variation occurring in the electricity supply of the building.

MORE DETAILED DESCRIPTION OF PREFERRED EMBODIMENTS OF THE INVENTION

Embodiment 1

Figure 1:
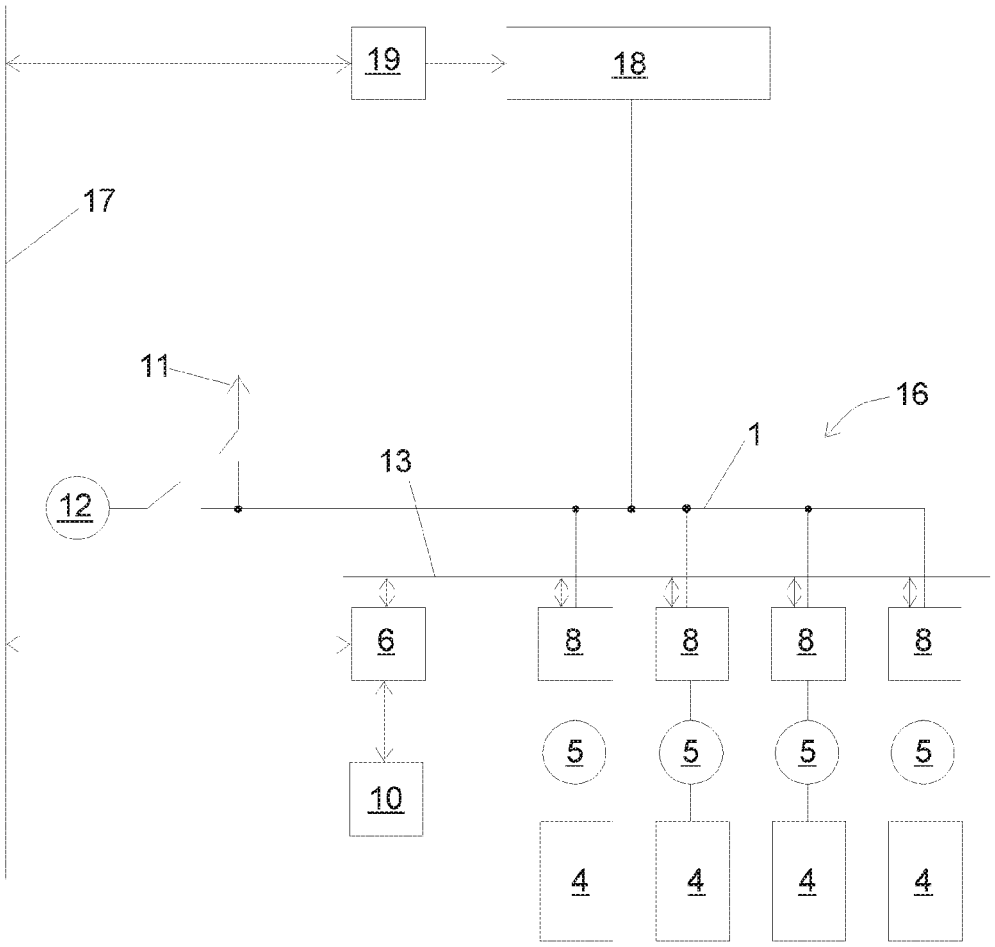
FIG. 1 presents a diagrammatic view of an elevator installation according to one embodiment.

FIG. 1 presents an elevator installation in a building, which elevator installation comprises an elevator group 16. The group controller 6 receives service requests given by elevator passengers with call-giving devices 10, and allocates via the data transfer bus 13 the service requests received to be served by elevator cars 4 belonging to the elevator group 16. The group controller 6 forms a run plan, i.e. a plan about how service requests will be distributed in a coordinated manner between the elevator cars 4 of the elevator group 16.

The group controller 6 divides the service requests between the elevator cars, and each elevator car is driven on the basis of service requests in such a way that the elevator car stops at floors according to the service requests.

The elevator installation of FIG. 1 is connected to the three-phase electricity distribution network 1 of the building The electricity supply from the public electricity network to the electricity distribution network 1 of the building occurs via the main supply 11 of the building. In addition, a reserve power generator 12, which supplies electricity to the building during an electricity outage occurring in the public electricity network, is connected to the electricity distribution network 1 of the building. Instead of a generator, also some other suitable electricity source can be used as a reserve power device, such as an accumulator, a solar cell, a fuel cell, a flywheel, a supercapacitor or a combination of these.

Each elevator of an elevator group comprises drive unit 8, which comprises an elevator control unit and also a frequency converter. The input of the frequency converter is connected to the electricity distribution network 1 of the building and the output is connected to the stator windings of the electric motor 5 of the hoisting machine 5. In this embodiment of the invention a permanent-magnet synchronous motor is used as an electric motor, but also e.g. a DC motor, induction motor or reluctance motor could be used as an electric motor instead of a permanent-magnet synchronous motor. An elevator car 4 is driven by supplying with a frequency converter electric power via the electricity distribution network 1 to the permanent-magnet synchronous motor of a hoisting machine 5 driving an elevator car, as well as by supplying electric power back to the electricity distribution network from a permanent-magnet synchronous motor braking an elevator car.

The group controller 6 is configured to form alternatives for a run plan for driving elevator cars on the basis of service requests. The software is also configured to estimate the electric power which the hoisting machines need for implementing the aforementioned alternatives, and also to select for use from the plurality of different alternatives a run plan, which when implemented causes the electric powers of the hoisting machines, when summed together, to smooth the power variation occurring in the electricity supply of the building, i.e. in the main supply 11 of the building or in connection with a reserve power device 12. For this reason the group controller 6 estimates the load of the different elevator cars 4 by estimating the number of passengers from the number of service requests for the elevator car 4. In addition the group controller 6 receives information from the sensor of the load-weighing device of each elevator car 4 about the load of the elevator car 4 in question. On the basis of the estimated and the measured load data the group controller calculates for each hoisting machine 5 an estimate for the power consumption during a run and also the sum $P_\Sigma$ of the power consumptions of the hoisting machines 5 from the viewpoint of the electricity supply of the building.

The group controller 6 also calculates the waiting time of an elevator, i.e. the time elevator passengers must wait for elevator service, for the different alternatives. A maximum waiting time, i.e. the longest permissible waiting time for an elevator, is also entered into the group controller 6. The maximum waiting time is consequently a performance indicator, which guarantees a certain level of elevator service. The group controller 6 removes those alternatives in which the waiting time of an elevator would exceed the aforementioned maximum waiting time and selects from a plurality of permitted alternatives for use a run plan, which when implemented the power variation in the electricity supply of the building is the smallest possible within the scope of the maximum waiting time. Consequently the power variation in the electricity supply of a building can be reduced without the level of elevator service falling if a maximum waiting time were to be exceeded.

The group controller 6 forms a number of alternatives for a run plan by dividing the service requests in alternative ways between the different elevator cars and also calculates the electric power needed by the hoisting machines 5 in the different alternatives as well as the sum $P_\Sigma$ of electric powers in a corresponding manner. In some embodiments the service requests are distributed in a coordinated manner between the different elevator cars 4 in such a way that the purpose of each elevator car 4 is to stop at floors according to service requests given to it. In some embodiments also the starting moment of an elevator car 4 leaving to serve one or more service requests is also altered in some alternatives. In some embodiments also the acceleration during the final part of the acceleration phase and/or the deceleration during the initial part of the deceleration phase of one or more elevator cars is adjusted in the alternatives. In some embodiments also the maximum speed of one or more elevator cars is adjusted in the alternatives. Described in more detail in connection with the description of FIGS. 3-7 below is that the magnitude of the power variation in the electricity supply of a building can differ significantly from one alternative to another.

The selection between alternative run plans can be made using optimization algorithms known in the art. One generally used algorithm is a genetic algorithm, the operation of which is described in international patent publication WO 01/65231 A2. Selections can be made in this way e.g. for minimizing the waiting times of an elevator, but here a genetic algorithm is utilized by minimizing the magnitude of the variation in the sum $P_\Sigma$ of the power consumptions of the hoisting machines from the viewpoint of the electricity supply of the building, in addition to, or instead of, minimizing waiting times. In some embodiments this is implemented by calculating the statistical dispersion index for the sum $P_\Sigma$ of power consumptions in each alternative run plan. In some embodiments the power consumption caused in the electricity supply of the building by loads external to the elevator installation are added to the sum $P_\Sigma$ of power consumptions, which addition is also taken into account when calculating the dispersion index. Most preferably the average deviation or variance of the sum $P_\Sigma$ of the power consumptions is used as the dispersion index. By means of a genetic algorithm a run plan is selected for use from a plurality of alternatives, with which run plan the aforementioned average deviation or variance of the sum $P_\Sigma$ of the power consumptions is the smallest. In some embodiments the selection is carried out by setting a penalty term for those run plans in which greatest instantaneous value of the sum $P_\Sigma$ exceeds the set threshold limit and also by favoring in the selection the run plans for which no penalty term is set, i.e. the run plans which do not exceed the aforementioned power limit.

In some embodiments a power limit is recorded in the memory of the group controller 6, which power limit the load in the electricity supply of the building may not exceed and the software of the group controller 6 is configured to select a run plan for use in the first instance, when implementing which run plan the electric powers of the hoisting machines, when summed together, smooth the power variation occurring in the electricity supply of the building in such a way that the maximum power in the electricity supply of the building does not exceed the aforementioned power limit. This means that, in addition to the dispersion index, a peak value for the sum $P_\Sigma$ of the power consumptions of the hoisting machines 5 is determined, which peak value is compared to the aforementioned power limit for the electricity supply of the building. Those alternatives in which the peak value would exceed the aforementioned power limit are then totally eliminated from the plurality of run plan alternatives. In some embodiments the selection of the run plan is carried out by setting a penalty term for those run plans in which greatest instantaneous value of the sum $P_\Sigma$ exceeds the power limit for the electricity supply of the building and also by favoring in the selection the run plans for which no penalty term is set.

The group controller 6 is also connected to a data transfer bus 17, which extends to outside the building. The data transfer bus 17 can be e.g. an internet connection, a wireless link or corresponding. In some embodiments the group controller 6 is configured to receive via the data transfer bus 17 control commands from outside the building from an electricity provider, on the basis of which the aforementioned power limit for the electricity supply is adjusted. Consequently the power limit can be increased or decreased in such a way that load of the generators of a power plant and at the same time the frequency of the electricity network would remain as stable as possible. In some embodiments the group controller 6 is configured to receive via the data transfer bus 17 from outside the building, from an electricity provider or e.g. from an electronic electricity exchange, information about momentary fluctuations in the price of electricity, in which case the power limit can e.g. be raised when electricity is momentarily cheap and the power limit can be lowered when the price of electricity momentarily increases. In this way the electricity bill for the building can be reduced at the same time, however, maintaining the level of the elevator service needed.

The solution of the description enables more efficient utilization of the existing infrastructure e.g. in areas in which the capacity of the public electricity network would otherwise start to run out. This is the type of situation e.g. in a part of Germany and also in the Manhattan district in New York, U.S.A., where society already offers financial incentives for reducing electricity consumption.

In FIG. 1 electric power is also supplied via the electricity distribution network 1 of the building to electrical devices 18 that are external to the elevator installation, which devices are thus connected to the electricity distribution network 1. With the building automation apparatus 19 the functions of the building are controlled by adjusting the electricity supply to the aforementioned devices 18 external to the elevator installation.

The building automation apparatus 19 is connected with a network switch (not presented in FIG. 1) to the same data transfer bus 17 as the group controller 6. The building automation apparatus 19 is configured to change the electricity consumption of the selected devices 18 external to the elevator installation in a manner specified by the group controller 6 on the basis of a change command to be received from the group controller 6. The devices are selected in such a way that e.g. a momentary electricity outage or current reduction in a device would not harm the users of the building. Suitable devices are consequently, inter alia, heating apparatus for household water, air-conditioning apparatus, a heating system and some of the lighting of a building.

The software of the group controller 6 is configured to form a change command for changing the electricity consumption of the building, and also to select for use in the first instance from the plurality of different alternatives a run plan, when implementing which run plan the sum $P_\Sigma$ of the electric powers of the hoisting machines 5, together with the changed electricity consumption of devices external to the elevator installation, smooth the power variation occurring in the electricity supply of the building in such a way that the maximum power in the electricity supply of the building does not exceed the set power limit. In this way an adequate level of elevator service can be ensured for users of the building particularly during an electricity outage or reduced distribution capacity of the electricity distribution network.

Figure 3A:
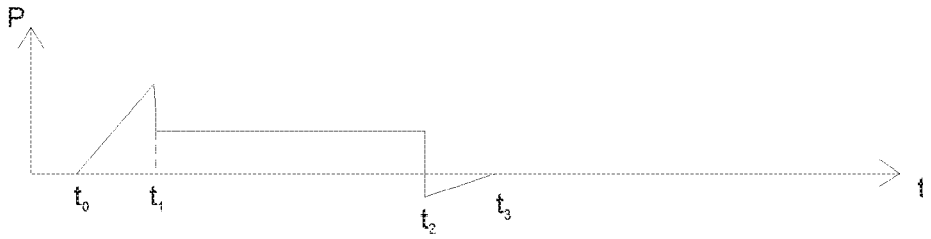
FIGS. 3*a*-3*c* present the graphs of the power produced in the electricity distribution network of a building by two elevators driving simultaneously in the heavy direction.
Figure 3B:
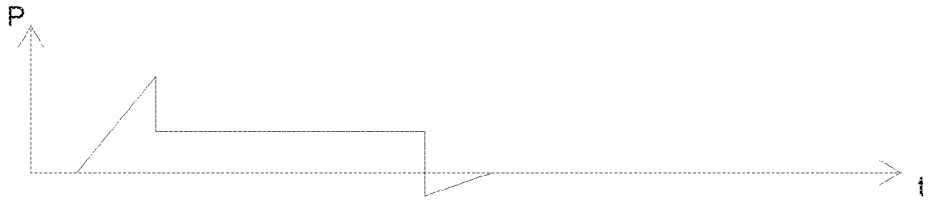

FIGS. 3*a* and 3*b*, and correspondingly FIGS. 4*a*, 4, 5*a* and 5*b*, present graphs of the power P of the hoisting machines 5 of elevators simultaneously driving in the heavy direction as a function of time t. In FIGS. 3-7 the graphs of power are presented for the sake of clarity in simplified form, omitting the rounding effect of the jerks of both the acceleration phase and the deceleration phase from the graphs. The heavy direction means the direction when driving in which the force effect on the traction sheave of the hoisting machine is in the direction of the movement of the elevator car, such as a fully-loaded elevator car driving upwards or an elevator car lighter than the counterweight driving downwards. In this case the permanent-magnet synchronous motor of the hoisting machine 5 takes power from the network, from the electricity distribution network of the building. Correspondingly, the light direction means the direction when driving in which the force effect on the traction sheave of the hoisting machine is in the opposite direction to the movement of the elevator car, such as an elevator car lighter than the counterweight driving upwards or a fully-loaded elevator car driving downwards. In this case the permanent-magnet synchronous motor 5 brakes and returns power back to the electricity distribution network of the building In FIGS. 3*a* and 3*b*, the elevator cars start moving simultaneously at the moment $t_0$ and their speed accelerates softly to maximum speed. After the elevator cars have reached maximum speed at the moment $t_1$, the run continues at constant speed until at the moment $t_2$ the elevator cars again start to decelerate, stopping at the stopping floor at the moment $t_3$. The power requirement of the hoisting machine 5 is at its greatest at the moment $t_1$ in the final phase of acceleration.

Figure 3C:
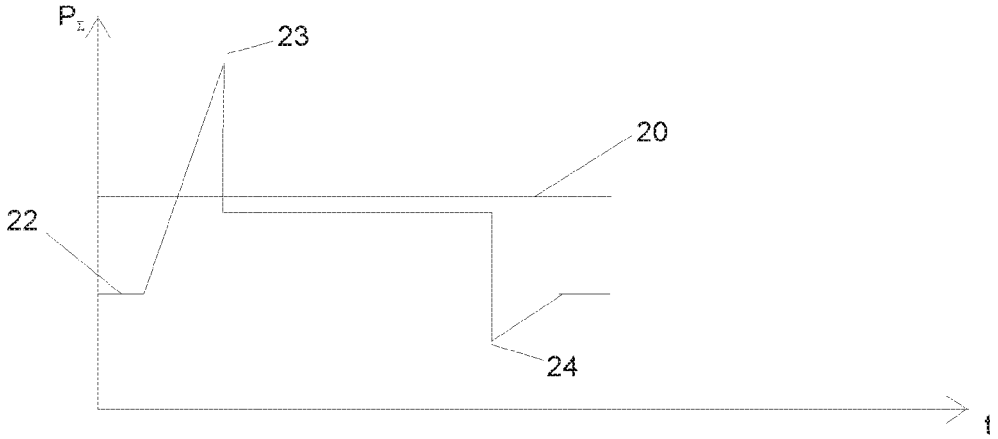
Figure 4A:
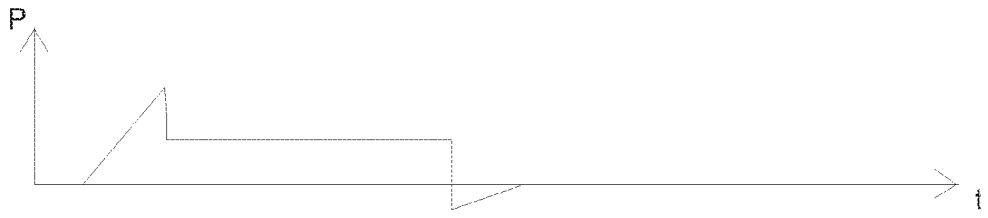
FIGS. 4*a*-4*d* present the graphs of the power produced in the electricity distribution network of a building by two elevators driving simultaneously in the heavy direction, when the power consumption is optimized by adjusting the electricity consumption of devices external to the elevator installation.
Figure 4B:
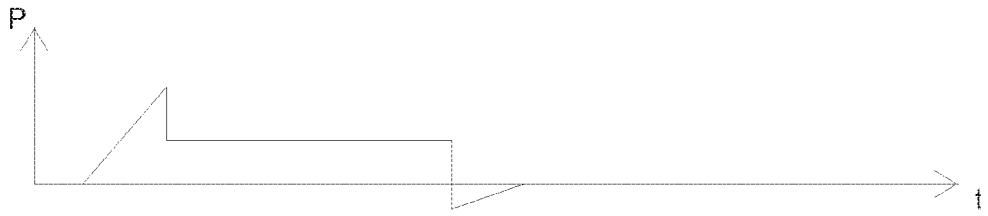
Figure 4C:
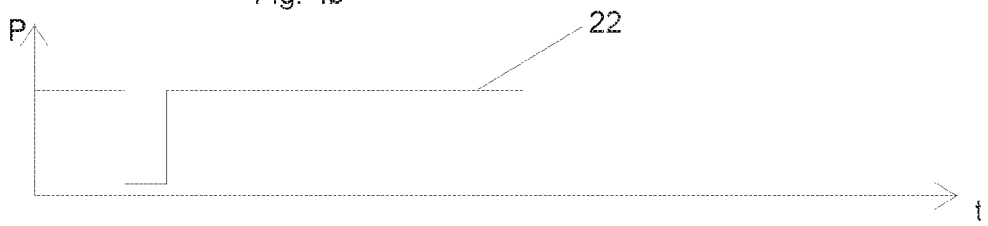
Figure 4D:
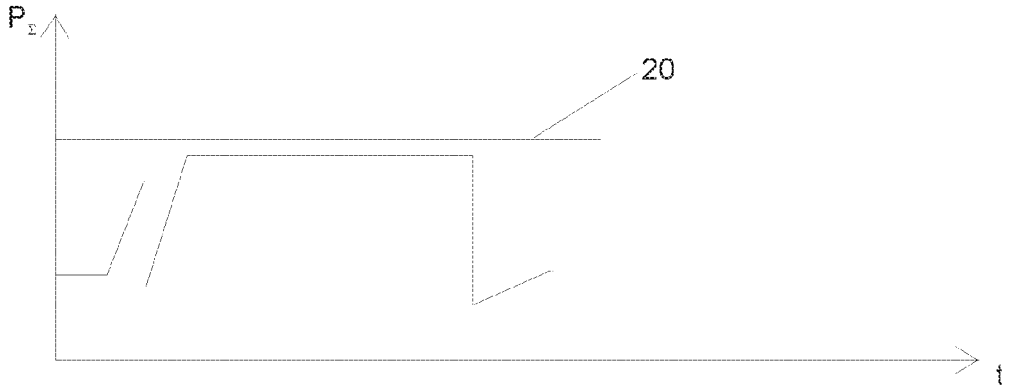

FIG. 3*c* presents the sum $P_\Sigma$, of power consumption of the hoisting machines 5, which sum loads the electricity supply of the building. In FIG. 3*c* it is assumed that the power consumption 22 of devices 18 external to the elevator installation remains constant during a run with the elevator. From FIG. 3*c* it is seen that the power variation, i.e. the difference between the peak value 23 and the minimum value 24 of the power, is strikingly large, and the sum $P_\Sigma$ also exceeds the power limit 20 of the electricity supply of the building. Set separately to the power limit 20 are a power limit during normal operation based on the fuse size of the main supply 11 of the building, and also a lower power limit during reserve power use according to the dimensioning of the reserve power generator 12. So that overshoot of the power limit 20 according to FIG. 3*c* could be avoided without deterioration of the elevator service, the group controller 6 optimizes the run plan of the elevator cars 4 in the manner presented in the preceding description. FIG. 4*c* presents how the group controller 6 controls the building automation apparatus 19 to reduce the electricity consumption 22 of devices 18 external to the elevator installation momentarily in the final phase of acceleration of the elevator cars 4 in such a way that the variation in summed power $P_\Sigma$ decreases. FIG. 4*d* presents the effect of optimization on the sum $P_\Sigma$ of the power consumption of the hoisting machines 5. As the power variation decreases also the peak value of power has fallen below the power limit 20 of the electricity supply of the building.

Figure 5A:
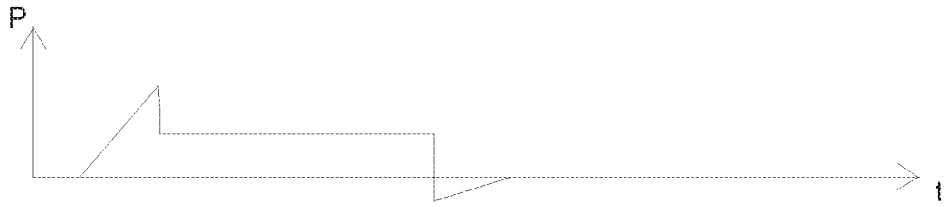
FIGS. 5*a*-5*c* present the graphs of the power produced in the electricity distribution network of a building by two elevators driving simultaneously in the heavy direction, when the power consumption is optimized by changing the moment of starting of one of the elevators.
Figure 5B:
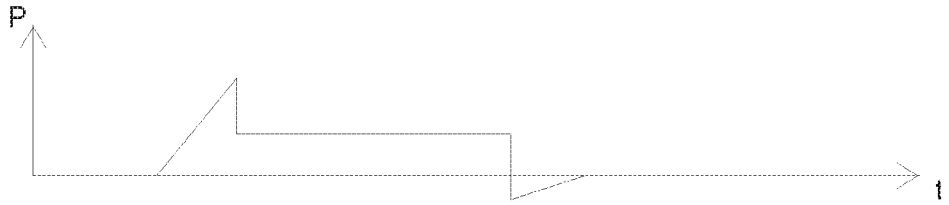
Figure 5C:
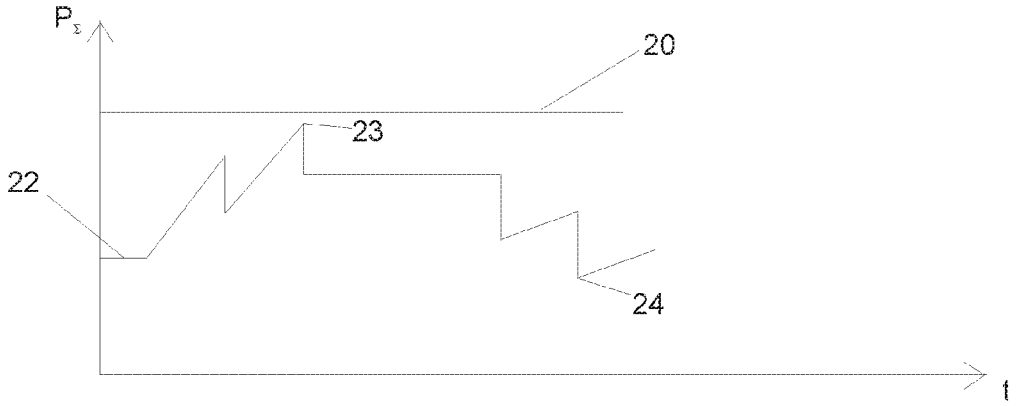

In the run plan presented in FIGS. 5*a*-5*c* the group controller 6 has delayed the starting moment of the second elevator, in which case the peak power needed by the different elevators occurs at different times, thus smoothing the variation of the summed power $P_\Sigma$.

Figure 6A:
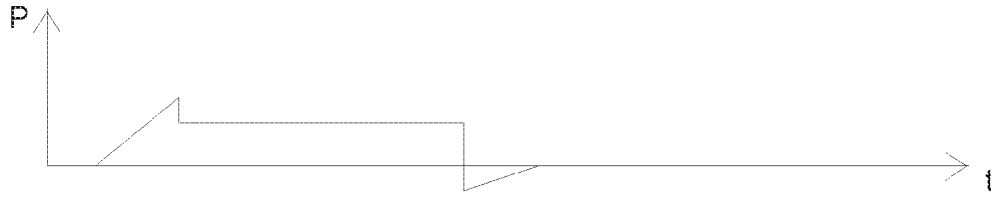
FIGS. 6*a*-6*c* present the graphs of the power produced in the electricity distribution network of a building by elevators driving simultaneously in the heavy direction and in the light direction.
Figure 6B:
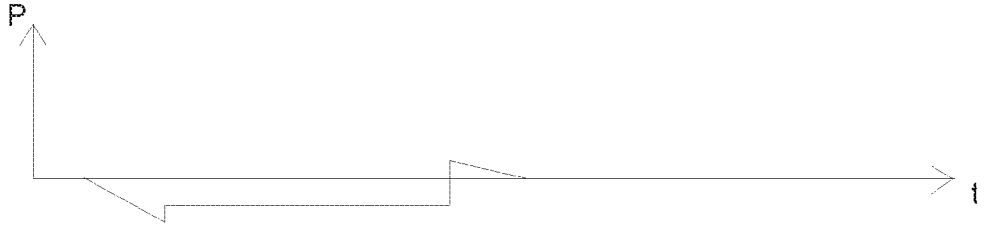
Figure 6C:
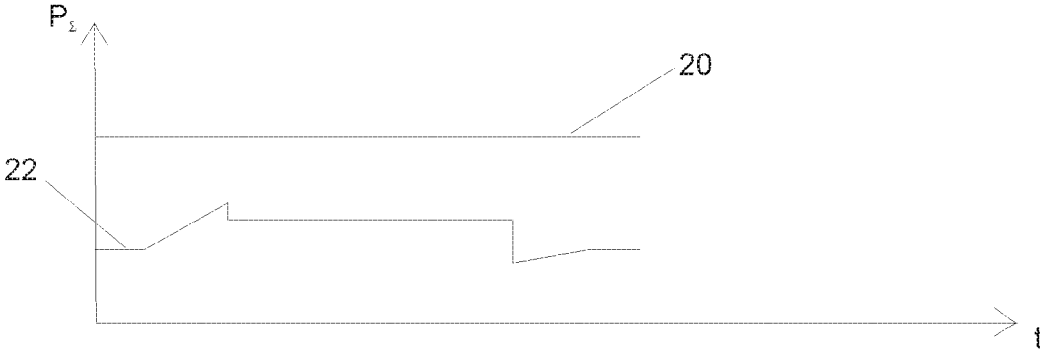

In the run plan presented in FIGS. 6*a*-6*c* the group controller 6 has selected one of the elevators to drive in the light direction (FIG. 6*b*), in which case the variation in summed power $P_\Sigma$ decreases.

Figure 7A:
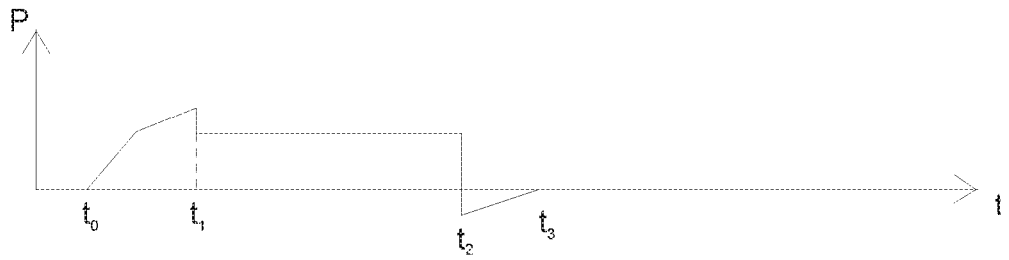
FIGS. 7*a*-7*c* present the graphs of the power produced in the electricity distribution network of a building by two elevators driving simultaneously in the heavy direction, when the power consumption is optimized by adjusting the acceleration and also the maximum speed of both elevators.
Figure 7B:
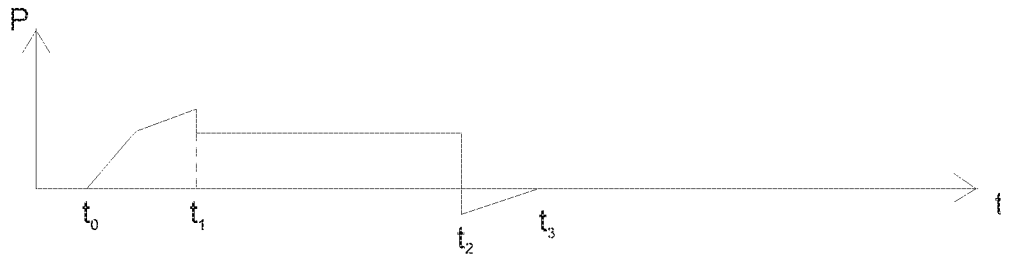
Figure 7C:
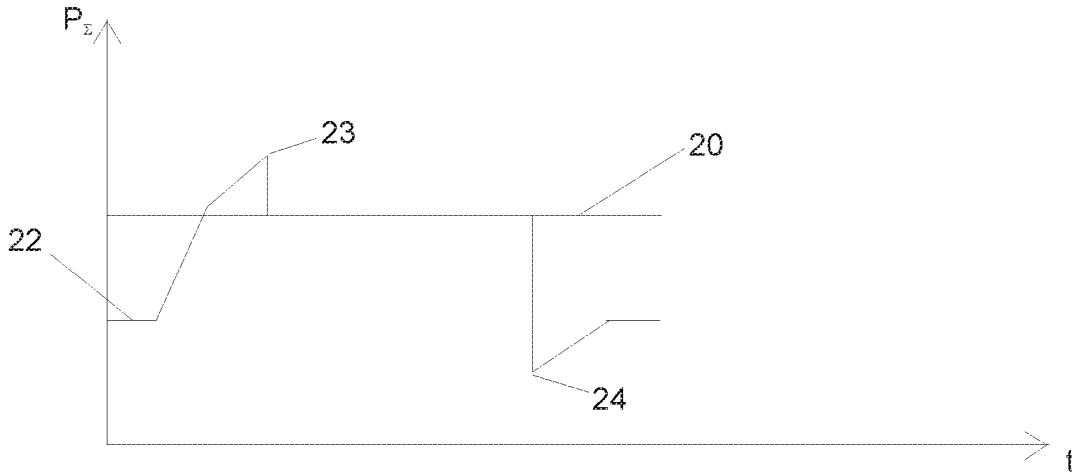

The solution presented in FIG. 7*c* differs from the situation of FIGS. 3*a*-3*c* in such a way that in the run plan the group controller 6 has reduced the acceleration of both the elevator cars driving in the heavy direction, more particularly during the final stage of the acceleration, as owing to the acceleration current the power consumption is greater than during even speed. In this case the summed power $P_\Sigma$ still exceeds the power limit 20, but the overshoot is significantly smaller than in the case of FIGS. 3*a*-3*c*. In order to compensate for the lower acceleration, the maximum speed of the elevator cars is correspondingly increased in such a way that the time spent on the run remains the same as in FIGS. 3*a*-3*c*. As the maximum speed increases, the power consumption during even speed increases slightly, but nevertheless still stays within the power limit 20.

In one embodiment, more particularly when driving in the light direction, the deceleration during the initial phase of deceleration is adjusted, in which case the braking power returning to the electricity distribution network 1 from the hoisting machine 5 is at its greatest.

Utilizing the control methods according to the description, the peak value of instantaneous power of the electricity supply of a building can be significantly reduced. In one case the greatest instantaneous power of the electricity supply of a building fell from 1500 kilowatts to 950 kilowatts with the control method according to the description.

Embodiment 2

Figure 2:
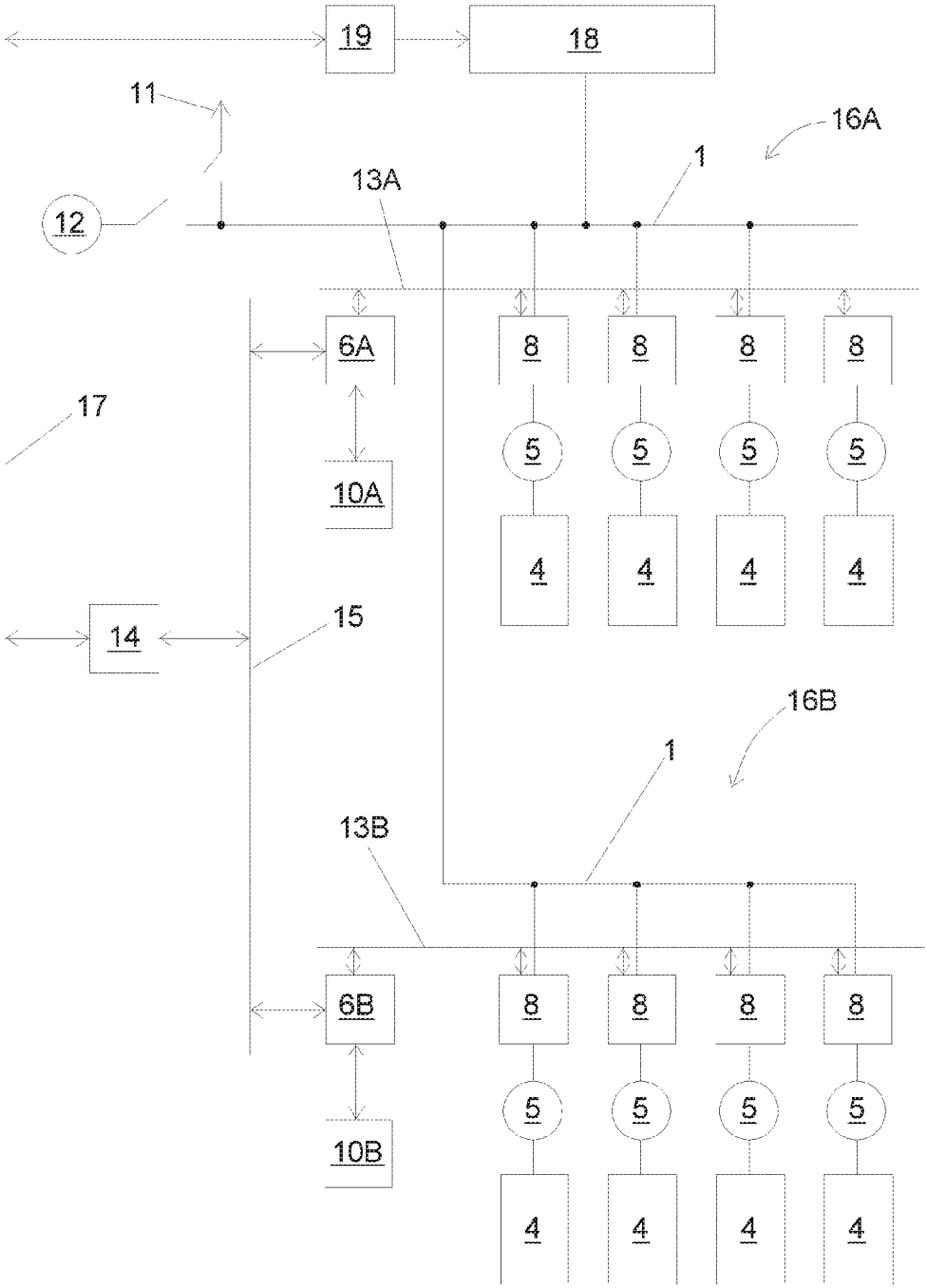
FIG. 2 presents a diagrammatic view of an elevator installation according to a second embodiment.

FIG. 2 presents an elevator installation in a building, in which, differing from FIG. 1, there are two elevator groups 16A and 16B, which have their own group controllers 6A and 6B. The group controller 6A receives service requests from the call-giving devices 10A and allocates via the data transfer bus 13A the service requests received to be served by elevator cars 4 belonging to the elevator group 16A. Correspondingly, the group controller 6B receives service requests from the call-giving devices 10B and allocates via the data transfer bus 13B the service requests received to be served by elevator cars belonging to the elevator group 16B. Both the group controllers 6A, 6B are configured to form a group-specific run plan in the same way, in terms of its basic principles, as is presented in the preceding embodiment 1.

The elevator installation of FIG. 2 also comprises a power management unit 14, which is connected with a data transfer bus 15 to the group controllers 6A, 6B.

The power management unit 14 first reads from one of the group controllers 6A, 6B an estimate for the sum $P_\Sigma$ of power consumptions during a run of the hoisting machines of the elevator group. The group controller 6A, 6B forms the aforementioned sum $P_\Sigma$ of power consumptions in the same way as was presented in embodiment 1. After this the power management unit 14 forms a group-specific power limit for that one of the group controllers 6A, 6B in such a way that the sum data $P_\Sigma$ of the power consumptions received from the first group controller, together with the aforementioned group-specific power limit, smoothes the power variation occurring in the electricity supply of the building. The power management unit 14 sends the group-specific power limit to the second group controller, and the second group controller further optimizes the power consumption of the elevators within the scope of its elevator group, endeavoring to ensure that the power consumption of the elevators of the group would not exceed the aforementioned group-specific power limit. The solutions described in connection with embodiment 1 are further used also in this group-specific optimization.

The solution according to embodiment 2 is advantageous particularly in large buildings, in which there are a number of elevator groups. By means of the power management unit 14 the power consumption of the different elevator groups can be optimized centrally, in which case the power variation in the electricity supply of a building can be smoothed even more than before.

The power management unit 14 can also be connected to the building automation apparatus 9 in such a way that with the power management unit the power variation in the electricity supply of a building can be smoothed more efficiently than before by changing the power consumption of electrical devices 18 that are external to the elevator installation in the same way as was presented in the embodiment 1.

In some further developed embodiments the power limit 20 for the electricity supply of the building according to embodiment 1 is recorded in the memory of the power management unit 14. The power management unit 14 compares the sum $P_\Sigma$ of the power consumptions received from the first group controller to the power limit 20 for the electricity supply of the building recorded in memory and, on the basis of the comparison, forms a group-specific power limit for the second group controller 6A, 6B in such a way that the sum data $P_\Sigma$ of the power consumptions received, together with the group-specific power limit, smooth the power variation occurring in the electricity supply of the building in such a way that the maximum power in the electricity supply of the building does not exceed aforementioned power limit 20.

In some further developed embodiments the power management unit 14 is connected to a data transfer bus 17 extending to outside the building, via which the power management unit 14 receives control commands for changing the power limit 20 of the electricity supply of the building in the same way as is presented in connection with the embodiment 1.

Embodiment 3

Figure 8:
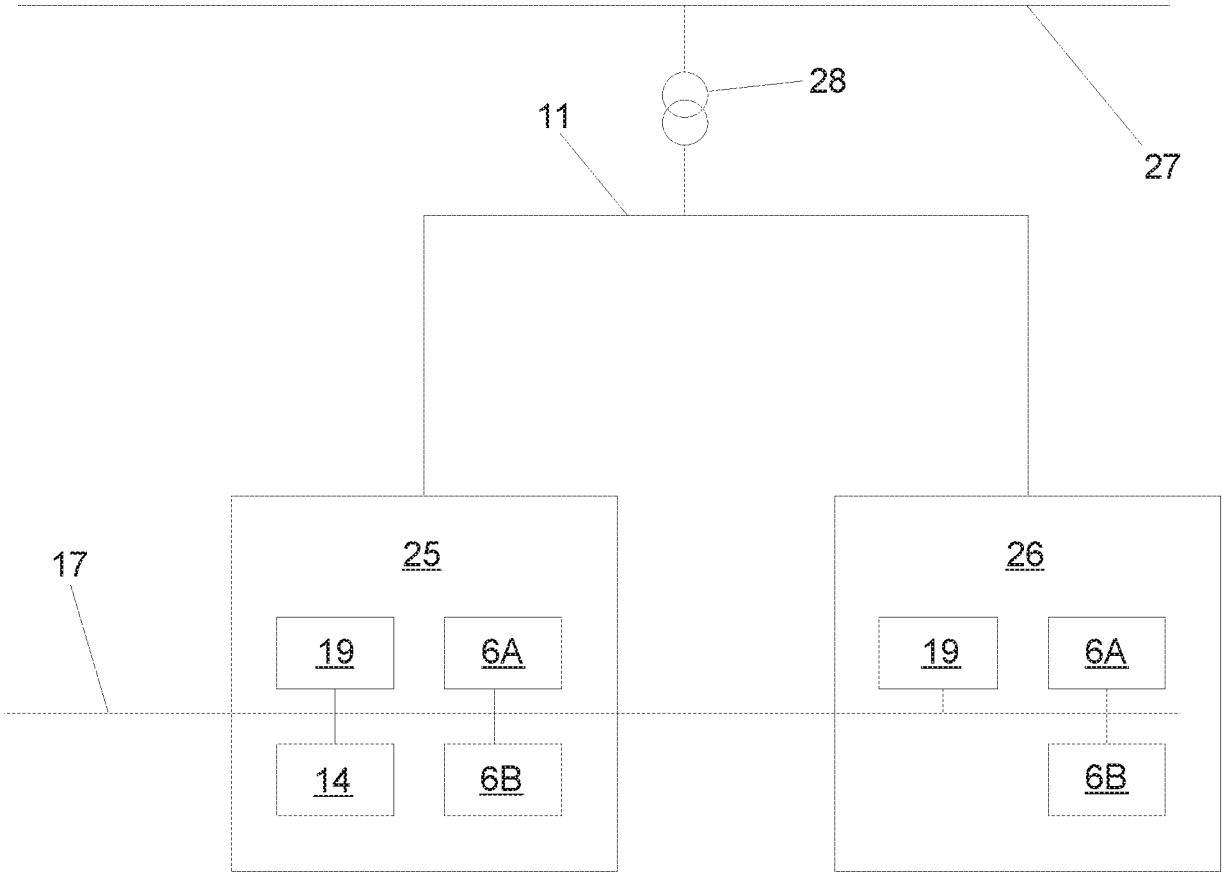
FIG. 8 presents a diagrammatic view of an elevator installation according to a third embodiment.

FIG. 8 presents two buildings 25, 26, in both of which is an elevator installation according to embodiment 2 configured in such a way that in both buildings 25, 26 are two elevator groups 16A and 16B according to FIG. 2, each of which elevator groups has its own group controller 6A and 6B. In addition, in the building 25 is a power management unit 14 according to the embodiment of FIG. 2, which power management unit is connected to the building automation apparatus 19 of the building 25 as well as to the group controllers 6A, 6B. In addition, the power management unit 14 is connected by means of an internet connection 17 to the group controllers 6A, 6B that are in the second building 26 as well as to the building automation apparatus 19.

The electricity supply in the buildings 25, 26 to devices 18 that are external to the elevator installation are controlled with the building automation apparatuses 19.

The electricity supply 11 to both buildings 25, 26 occurs with the same supply transformer 28 from the public electricity network 27.

The power management unit 14 is further connected with an internet connection 27 to an electricity provider of the public electricity network.

In the building 25 the group controllers 6A, 6B receive service requests from the call-giving devices 10A, 10B (see FIG. 2) and allocate via the data transfer bus 13A, 13B the service requests received to be served by elevator cars 4 belonging to the elevator group 16A, 16B.

Correspondingly, in the building 26 the group controllers 6A, 6B receive service requests from the call-giving devices 10A, 10B and allocate via the data transfer bus 13A, 13B the service requests received to be served by elevator cars belonging to the elevator group 16A, 16B. Both the group controllers 6A, 6B of both the buildings 25, 26 are configured to form a group-specific run plan in the same way, in terms of its basic principles, as was presented in connection with embodiment 1.

The group controllers 6A, 6B of the different buildings 25, 26 function in cooperation via the internet connection 17 coordinated by the power management unit 14. The power management unit 14 first reads from the group controllers 6A, 6B of the building 25 (or alternatively from the group controllers 6A, 6B of the building 26) an estimate for the sum $P_\Sigma$ of power consumptions during a run of the hoisting machines of the elevator group. The group controller 6A, 6B forms the aforementioned sum $P_\Sigma$ of power consumptions in the same way as was presented in embodiment 1. After this the power management unit 14 forms a group-specific power limit for the group controllers 6A, 6B of the building 26 (or alternatively for the group controllers 6A, 6B of the building 25) in such a way that the sum data $P_\Sigma$ of the power consumptions received from the group controllers of the building 25, together with the aforementioned group-specific power limit, smoothes the power variation occurring in the common electricity supply 11 of the buildings 25, 26. The power management unit 14 sends the group-specific power limit via the internet connection 17 to the group controllers 6A, 6B of the building 26, and the group controllers 6A, 6B of the building 26 both further optimize the power consumption of the elevators within the scope of their own elevator group, endeavoring to ensure that the power consumption of the elevators of the group does not exceed the aforementioned group-specific power limit. The solutions described in connection with embodiment 1 above are used also in this group-specific optimization.

The solution according to embodiment 3 enables the power variation in the shared electricity supply 11 of the buildings 25, 26 to be further reduced, in which case, inter alia, the dimensioning of the supply transformer 28 can be reduced.

In some further developed embodiments the power limit 20 for the electricity supply common to the buildings 25, 26 according to embodiment 1 is recorded in the memory of the power management unit 14. The power management unit 14 compares the sum $P_\Sigma$ of the power consumptions received from the group controllers of the building 25 to the power limit 20 recorded in memory and on the basis of the comparison forms a group-specific power limit for the group controllers 6A, 6B of the building 26 in such a way that the sum data $P_\Sigma$ of the power consumptions received, together with the group-specific power limit, smooth the power variation occurring in the common electricity supply 11 of the buildings 25, 26 in such a way that the maximum power in the electricity supply 11 does not exceed aforementioned power limit 20.

In some embodiments the electricity provider can adjust the aforementioned power limit 20 via an internet connection in the same way as is described in embodiments 1 and 2.

In some embodiments the power management unit 14 also adjusts the electricity supply of devices 18 external to the elevator installation by giving change commands to the building automation apparatuses 19, in the same way as is described in embodiments 1 and 2.

In embodiment 3, instead of two different buildings 25, 26, at issue can also be two functional parts 25, 26 of the same building that are clearly separate from each other. On the other hand, embodiment 3 is suited for use also in an entity comprising more than two buildings 25, 26, when the buildings belonging to the entity have a shared electricity supply 11. Consequently, these can be e.g. all the buildings of the same block that are supplied with a shared supply transformer 28.

With the solution of embodiment 3 a particularly large advantage is achieved if the functional purposes of the clearly separate functional parts 25, 26 of the buildings/of the same building differ from each other e.g. in such a way that the electricity consumption of the different buildings/functional parts 25, 26 is at its greatest at different times of day. In this case e.g. an office building and a hotel have a differing functional purpose. In an office building the power requirement of the elevators is at its greatest during the morning rush hour, when people arrive in the building. On the other hand, in the morning people leave a hotel, in which case when people leave the elevators convert the potential energy back into electrical energy. In hotels, on the other hand, the power requirement is generally highest in the afternoon when passengers arrive. Correspondingly, in the afternoon people leave an office building to go to their homes, in which case when people leave the potential energy is converted back into back electrical energy by the elevators. When the electric power of the office building and of the hotel is in this case taken from behind the same electricity supply 11, the power variation in the electricity supply 11 can be smoothed more than before by utilizing the electrical energy being released in the hotel in the morning for driving people up in the office building with an elevator and also, on the other hand, by utilizing the electrical energy being released in the office building in the afternoon for driving people up in the hotel.

In the description, public electricity network 27 means a common electricity network for a larger area, in which one or more electricity providers produce electric power. Electricity providers can be e.g. one or more of the following: a coal-fired power station, nuclear power station, wind power station, hydroelectric power station, solar power station, wave power station, gas-fired power station, diesel power station functioning with a diesel generator.

The invention is not only limited to be applied to the embodiments described above, but instead many variations are possible within the scope of the inventive concept defined by the claims.

The invention claimed is:

1. An elevator installation in a building, the building including an electricity distribution network, the electricity distribution network electrically coupled to an electricity supply of the building, the elevator installation comprising:

a plurality of elevator cars;

a plurality of hoisting machines, each hoisting machine configured to drive a separate elevator car of the plurality of elevator cars;

a plurality of power supply devices, each power supply device configured to control a supply of electrical power between the electricity distribution network and a separate hoisting machine of the plurality of hoisting machines based on elevator drive commands received at the power supply device, respectively;

a controller device electrically coupled to the plurality of power supply devices, the controller device configured to, based on receiving at least one elevator service request, generate a plurality of alternative run plans to drive at least one elevator car to complete the at least one elevator service request, each alternative run plan including a separate set of elevator drive commands to drive at least one of the elevator cars to complete the at least one elevator service request;

associate each given alternative run plan with a separate, respective estimated time variation of electrical power consumption of the electricity supply, the estimated time variation of electrical power consumption associated with driving the at least one of the elevator cars to complete the given alternative run plan;

select a run plan from the alternative run plans, based on the selected run plan being associated with a minimum time variation of electrical power consumption of the electricity supply; and generate one or more elevator drive commands to command at least one of the power supply devices to drive at least one of the elevator cars according to the selected run plan.

2. The elevator installation according to claim 1, wherein, the controller device is configured to record a power limit associated with the electricity supply of the building; and the selected run plan is associated with a maximum electrical power consumption of the electricity supply that is less than or equal to the power limit.

3. The elevator installation according to claim 1, wherein, the controller device is electrically coupled to a building automation apparatus through a data transfer bus, the building automation apparatus configured to control electrical power consumption of the electricity supply by one or more devices of the building, the one or more devices being external to the elevator installation;

the controller device is configured to generate one or more control signals to the building automation apparatus to change the electrical power consumption of the electricity supply by the one or more devices; and the building automation apparatus is further configured to change the electrical power consumption of the electricity supply by the one or more devices external to the elevator installation based on the one or more control signals received from the controller device.

4. The elevator installation according to claim 3, wherein the controller device is configured to, generate one or more control signals to change the electrical power consumption of the electricity supply by the one or more devices;

associate at least one given alternative run plan with a separate, respective estimated time variation of electrical power consumption of the electricity supply of the building, the estimated time variation of electrical power consumption associated with both driving the plurality of elevator cars to complete the at least one given alternative run plan and changing the electrical power consumption of the electricity supply by the one or more devices, according to at least one control signal, to reduce the time variation of electrical power consumption of the at least one given alternative run plan;

select a run plan from the alternative run plans, based on the selected run plan being associated with a minimum time variation of electrical power consumption of the electricity supply.

5. The elevator installation according to claim 4, wherein the controller device is configured to, select a run plan from the alternative run plans, based on the selected run plan being associated with a minimum time variation of electrical power consumption variation of the electricity supply, and a maximum electrical power consumption of the electricity supply that is less than or equal to a power limit of the electricity supply.

6. The elevator installation according to claim 1, wherein, the elevator installation further includes, a power management device, and a plurality of elevator groups, wherein each elevator group includes a plurality of elevator cars configured to complete one or more elevator service requests, and a group controller electrically coupled to the power management device;

each group controller is configured to, generate a group-specific run plan for driving the elevator cars of the elevator group to complete one or more elevator service requests, and determine the electric power consumption by the hoisting machines need to complete the generated group-specific run plan, the power management device is configured to receive, from each group controller in each given elevator group, information indicating separate electrical power consumption values associated with each separate hoisting machine in the given elevator group to complete a group-specific run plan associated with the given elevator group, compare the electric power consumption values indicated in the received information, and determine a group-specific power limit associated with one or more group controllers such that each of the alternative run plans includes group-specific run plans associated with separate, respective elevator groups; and communicate each group-specific power limit to a corresponding one or more group controllers;

each given group controller of each given elevator group of the elevator installation is configured to to determine a plurality of alternative group-specific run plans associated with the given elevator group, each alternative group-specific run plan being a run plan to drive one or more of the elevator cars of the given elevator group to complete the at least one elevator service request, associate each given alternative group-specific run plans with a separate, respective estimated time variation of electrical power consumption of the electricity supply, the estimated time variation of electrical power consumption of the electricity supply being associated with driving at least one of the elevator cars of the given elevator group to complete the given alternative group-specific run plan; and select a group-specific run plan from the alternative group-specific run plans, based on the selected group-specific run plan associated with a maximum estimated electrical power consumption that is less than or equal to the group-specific power limit communicated to the group controller.

7. The elevator installation according to claim 6, wherein, the power management device is configured to record a power limit associated with the electricity supply of the building, compare electrical power consumption information received from the group controllers to the power limit, determine, for each given group controller, a group-specific power limit associated with the given group controller, and select a run plan from the alternative run plans, each of the alternative run plans including a separate group-specific run plan associated with each separate elevator group, based on the selected run plan being associated with a minimum estimated time variation of electrical power consumption of the electricity supply, the estimated time variation of electrical power consumption of the electricity supply of each given alternative run plan including a separate estimated time variation of electrical power consumption of the electricity supply associated with each separate group-specific run plan included in the given alternative run plan, and a maximum electrical power consumption of the electricity supply that is less than or equal to the power limit, the maximum electrical power consumption of the electricity supply of each given alternative run plan including a separate maximum electrical power consumption of the electricity supply associated with each separate group-specific run plan included in the given alternative run plan.

8. The elevator installation according to claim 1, wherein in each alternative run plan includes a set of elevator drive commands that distribute the completion of the service requests between two or more of the elevator cars in such that each of the two or more elevator cars stops at one or more floors according to a separate service request.

9. The elevator installation according to claim 8, wherein, each alternative run plan is associated with a start time, the start time indicating a time at which an elevator executing the run plan initiates movement from a floor; and at least two of the alternative run plans are associated with different start times.

10. The elevator installation according to claim 8, wherein, each alternative run plan is associated with an acceleration value, the acceleration value indicating at least one of a magnitude of acceleration of an elevator car during an initial phase of acceleration and a magnitude of acceleration of the elevator car during a final phase of acceleration; and at least two of the alternative run plans are associated with different acceleration values.

11. The elevator installation according to claim 8, wherein at least two of the alternative run plans are associated with different maximum elevator car speed values.

12. The elevator installation according to claim 2, wherein, the controller device is configured to adjust the power limit of the electricity supply of the building.

13. The elevator installation according to claim 1, wherein the electricity supply of the building is a main power supply of the building.

14. The elevator installation according to claim 13, wherein, the controller device is configured to adjust the power limit of the main power supply, based on a control signal received from a data transfer bus external to the building.

15. The elevator installation according to claim 1, wherein the electricity supply of the building is a reserve power device.

16. The elevator installation according to claim 1, wherein the controller device is configured to, determine a maximum elevator waiting time associated with each elevator car;

calculate an elevator waiting time for each of the alternative run plans; and select the selected run plan based at least in part upon the maximum elevator waiting time, such that the selected run plan is associated with the minimum estimated time variation of electrical power consumption of the electricity supply and is further associated with elevator car waiting times that are less than or equal to the maximum elevator waiting time.

17. An elevator system, comprising:

a first elevator installation included in a first building;

a second elevator installation included in a second building, wherein the first and second buildings include separate, respective electricity distribution networks, each of the electricity distribution networks electrically coupled to a common electricity supply;

wherein each given elevator installation of the first and second elevator installations includes, a plurality of elevator cars;

a plurality of hoisting machines, each hoisting machine configured to drive a separate elevator car of the plurality of elevator cars;

a plurality of power supply devices, each power supply device configured to control a supply of electrical power between the electricity distribution network and a separate hoisting machine of the plurality of hoisting machines based on elevator drive commands received at the power supply device, respectively;

a controller device electrically coupled to the plurality of power supply devices;

wherein each given controller device of the first and second elevator installations is configured to, based on receiving at least one elevator service request generate a plurality of alternative run plans to drive at least one elevator car to complete the at least one elevator service request, each alternative run plan including a separate set of elevator drive commands to drive at least one of the elevator cars to complete the at least one elevator service request; and associate each given alternative run plan with a separate, respective estimated time variation of electrical power consumption of the electricity supply, the estimated time variation of electrical power consumption associated with driving the at least one of the elevator cars to complete the given alternative run plan; and wherein the controller devices of the first and second elevator installations are configured to collectively select a set of run plans, each run plan of the selected set selected from a separate plurality of alternative run plans of a separate elevator installation, based on the selected set of run plans being associated with a minimum time variation of electrical power consumption of the electricity supply.

18. The elevator system according to claim 17, wherein the buildings are associated with different functions, such that the buildings are associated with respective peak electrical power consumption at different times.

19. A method for controlling one or more elevators in an elevator installation, the elevator installation included in a building, the elevator installation including a plurality of elevator cars, the method comprising:

generating a plurality of alternative run plans to drive at least one elevator car to complete at least one elevator service request, each alternative run plan including a separate set of elevator drive commands to drive at least one of the elevator cars to complete the at least one elevator service request;

associating each given alternative run plan with a separate, respective estimated time variation of electrical power consumption of an electricity supply of the building, the estimated time variation of electrical power consumption associated with driving the at least one of the elevator cars to complete the given alternative run plan;

selecting a run plan from the alternative run plans, based on the selected run plan being associated with a minimum time variation of electrical power consumption of the electricity supply; and generating one or more elevator drive commands to drive at least one of the elevator cars according to the selected run plan.

20. The method according to claim 19, wherein the selected run plan is associated with a maximum electrical power consumption of the electricity supply that is less than or equal to a power limit of the electricity supply.

21. The method according to claim 19, further comprising:

adjusting electrical power consumption of the electricity supply by one or more external devices in the building, the one or more external devices external to the elevator installation, such that the time variation of electrical power consumption of the electricity supply associated with at least one alternative run plan includes the time variation of electrical power consumption by one or more external devices in the building.

22. The method according to claim 21, wherein the time variation of electrical power consumption of the electricity supply has a maximum electrical power consumption that is less than or equal to a power limit of the electricity supply of the building.

23. The method according to claim 19, wherein, the elevator installation includes, a power management device, and a plurality of elevator groups, wherein each elevator group includes, a plurality of elevator cars configured to one or more service requests, and a group controller electrically coupled to the power management device;

each group controller configured to, generate a group-specific run plan for driving the elevator cars of the elevator group to complete one or more elevator service requests, and determine the electric power consumption by the hoisting machines need to complete the generated group-specific run plan, the power management device is configured to receive, from each group controller in each given elevator group, information indicating separate electrical power consumption values associated with each separate hoisting machine in the given elevator group to complete a group-specific run plan associated with the given elevator group, compare the electric power consumption values indicated in the received information, and determine a group-specific power limit associated with one or more group controllers such that each of the alternative run plans includes group-specific run plans associated with separate, respective elevator groups; and communicate each group-specific power limit to a corresponding one or more group controllers;

each given group controller of each given elevator group of the elevator installation is configured to determine a plurality of alternative group-specific run plans associated with the given elevator group, each alternative group-specific run plan being a run plan to drive one or more of the elevator cars of the given elevator group to complete the at least one elevator service request, associate each given alternative group-specific run plans with a separate, respective estimated time variation of electrical power consumption of the electricity supply, the estimated time variation of electrical power consumption of the electricity supply associated with driving at least one of the elevator cars of the given elevator group to complete the given alternative group-specific run plan; and select a group-specific run plan from the alternative group-specific run plans, based on the selected group-specific run plan associated with a maximum estimated electrical power consumption that is less than or equal to the group-specific power limit communicated to the group controller.

24. The method according to claim 23, further comprising:

comparing electrical power consumption values received from the group controllers with the power limit for the electricity supply of the building, the electrical power consumption values associated with implementing the group-specific run plans, and determining, for each given group controller, a group-specific power limit associated with the given group controller, selecting a run plan from the alternative run plans, each of the alternative run plans including a separate group-specific run plan associated with each separate elevator group, based on the selected run plan being associated with a minimum estimated time variation of electrical power consumption of the electricity supply, the estimated time variation of electrical power consumption of the electricity supply of each given alternative run plan including a separate estimated time variation of electrical power consumption of the electricity supply associated with each separate group-specific run plan included in the given alternative run plan, and a maximum electrical power consumption of the electricity supply that is less than or equal to the power limit, the maximum electrical power consumption of the electricity supply of each given alternative run plan including a separate maximum electrical power consumption of the electricity supply associated with each separate group-specific run plan included in the given alternative run plan, and communicating the group-specific power limit to one or more group controllers.

25. The method according to claim 19, wherein wherein each alternative run plan includes a set of elevator drive commands that distribute the completion of the service requests between two or more of the elevator cars such that each of the two or more elevator cars stops at one or more floors according to a separate service request.

26. The method according to claim 25, wherein each alternative run plan is associated with a start time, the start time indicating a time at which an elevator executing the run plan initiates movement from a floor; and at least two of the alternative run plans are associated with different start times.

27. The method according to claim 25, wherein each alternative run plan is associated with an acceleration value, the acceleration value indicating at least one of a magnitude of acceleration of an elevator car during an initial phase of acceleration and a magnitude of acceleration of the elevator car during a final phase of acceleration; and at least two of the alternative run plans are associated with different acceleration values.

28. The method according to claim 25, wherein at least two of the alternative run plans are associated with different maximum elevator car speed values.

29. The method according to claim 19, wherein the electricity supply of the building is a main power supply of the building.

30. The method according to claim 29, further comprising:

adjusting the power limit of the main power supply, based on a control signal received from a data transfer bus external to the building.

31. The method according to claim 19, wherein the electricity supply of the building is a reserve power device.

32. The method according to claim 19, further comprising:

determining a maximum elevator waiting time associated with each elevator car;

calculating an elevator waiting time for each of the alternative run plans; and selecting the selected run plan based at least in part upon the maximum elevator waiting time, such that the selected run plan is associated with the minimum estimated time variation of electrical power consumption of the electricity supply and is further associated with elevator car waiting times that are less than or equal to the maximum elevator waiting time.

* * * * *